US010772447B2

(12) United States Patent
Roaks

(10) Patent No.: US 10,772,447 B2
(45) Date of Patent: Sep. 15, 2020

(54) DINING PLACEMAT WITH INTERCHANGEABLE TABLEWARE

(71) Applicant: Twistshake of Sweden AB, Vasteras (SE)

(72) Inventor: Vienar Roaks, Vasteras (SE)

( * ) Notice: Subject to any disclaimer, the term of this patent is extended or adjusted under 35 U.S.C. 154(b) by 0 days.

(21) Appl. No.: 15/621,514

(22) Filed: Jun. 13, 2017

(65) Prior Publication Data

US 2018/0352984 A1 Dec. 13, 2018

(51) Int. Cl.

| | |
|---|---|
| ***A47G 19/10*** | (2006.01) |
| ***A47G 23/03*** | (2006.01) |
| ***B65D 21/02*** | (2006.01) |
| ***A47G 29/093*** | (2006.01) |

(52) U.S. Cl.

CPC ..... *A47G 19/10* (2013.01); *A47G 23/0303* (2013.01); *A47G 29/093* (2013.01); *B65D 21/0222* (2013.01); *A47G 23/03* (2013.01)

(58) Field of Classification Search

CPC .. A47G 19/10; A47G 23/0303; A47G 23/093; A47G 29/093; B65D 21/0223

See application file for complete search history.

(56) References Cited

U.S. PATENT DOCUMENTS

D254,831 S * 4/1980 Smith ..... D7/540
6,318,683 B1 * 11/2001 Savoy ..... A47D 1/008 248/146
9,132,932 B2 * 9/2015 Scharfe ..... A47G 19/2283
2003/0075666 A1 * 4/2003 Dunchock ..... A47G 19/10 248/682
2007/0254134 A1 * 11/2007 Han ..... A47G 23/0303 428/120
2013/0206781 A1 * 8/2013 MacCormick ..... A47G 19/2227 220/694
2015/0230638 A1 * 8/2015 Jagger ..... A47G 19/10 220/574
2016/0073805 A1 * 3/2016 Laurain ..... A47G 19/02 220/575

FOREIGN PATENT DOCUMENTS

GB 405174 A * 2/1934 ..... A47G 29/093
WO WO-2018107190 A1 * 6/2018 ..... A47G 23/0303

* cited by examiner

*Primary Examiner* — Mollie Impink
(74) *Attorney, Agent, or Firm* — Ingram IP Law, P.A.

(57) ABSTRACT

A tableware system is provided that includes a placemat with non-integrated tableware. The placemat includes a substantially planar bottom surface that forms a partial vacuum when provided in contact with an underlying surface and a first fastening mechanism provided at a top surface of the placemat. The tableware includes a second fastening mechanism that corresponds to the first fastening mechanism, the second fastening mechanism being detachably coupled to the first fastening mechanism. A lid is provided that secures to the tableware and includes another first fastening mechanism provided at a top surface thereof. A lock is provided that fixedly secures the first fastening mechanism and the second fastening mechanism. The lock may include a release mechanism that disengages the lock upon application of a force thereto. Alternatively, the lock may be removable by a separate tool that disengages the lock to allow the tableware and the placemat to be detached.

20 Claims, 4 Drawing Sheets

DINING PLACEMAT WITH INTERCHANGEABLE TABLEWARE

FIELD OF THE TECHNOLOGY

The technology relates to dining placemat with non-integrated tableware and more particularly to dining placemat that suctions to an underlying surface and includes separable tableware, and still more particularly to dining placemat that secures to an underlying surface by a partial vacuum and includes a mechanism for fastening tableware thereto.

BACKGROUND OF THE TECHNOLOGY

Traditionally, food is placed on tableware such as plates or bowls and served for consumption at a table. At the end of a meal, the tableware is carried to a sink, dishwasher, or other station for washing. Older children and adults typically possess sufficient motor skills and coordination to neatly feed themselves such that food is either consumed or maintained on the tableware. Occasionally, placemats may be provided underneath the tableware to catch crumbs or other food debris that may otherwise fall on a surface of the table around the tableware. When placemats are used, the placemats may be carried to the sink for a quick wipe down after a meal. Ideally, a combination of the tableware and the placemats allow for minimal clean-up to the table after each meal.

By comparison, infants and special needs children may lack motor skills and coordination needed to neatly feed themselves during a meal. Furthermore, adults may lose motor skills or coordination due to a medical condition such as a stroke or age. In these instances, traditional tableware may become a hindrance during mealtime. For example, the tableware may be inadvertently overturned or knocked off a table while attempting to grasp food placed therein. Alternatively, the tableware may be deliberately overturned or knocked off a table due to frustrations arising from an inability to access food placed therein.

One known solution includes dispensing with the tableware and providing food directly onto a placemat that is placed on surface such as a table top. While this solution is adequate for certain solid foods, it is inadequate for other foods including soup, applesauce, rice, or the like. Another known solution includes providing a placemat with integrated, non-separable tableware, where the placemat is affixed to a surface such as a table top. While the affixed placemat with integrated tableware enables consumption of various food types, the non-separable placemat is a hindrance to conventional food preparation and tableware storage. For example, the non-separable placemat may be sized such that it does not fit in a microwave or prevents proper operation of the microwave. In these instances, conventional tableware must be employed to prepare food that is subsequently transferred to the placemat with integrated tableware. The need for conventional tableware to prepare or heat food requires additional washing. Furthermore, the non-separable placemat may be sized such that it does not fit in a cupboard or prevents efficient stacking. Still further, there is considerable material waste in providing non-separable placemats with each piece of tableware. Ultimately, the material waste and need for additional washing associated with known solutions are harmful to the environment. These and other drawbacks exist with known solutions.

DETAILED DESCRIPTION OF THE TECHNOLOGY

Figure 1:
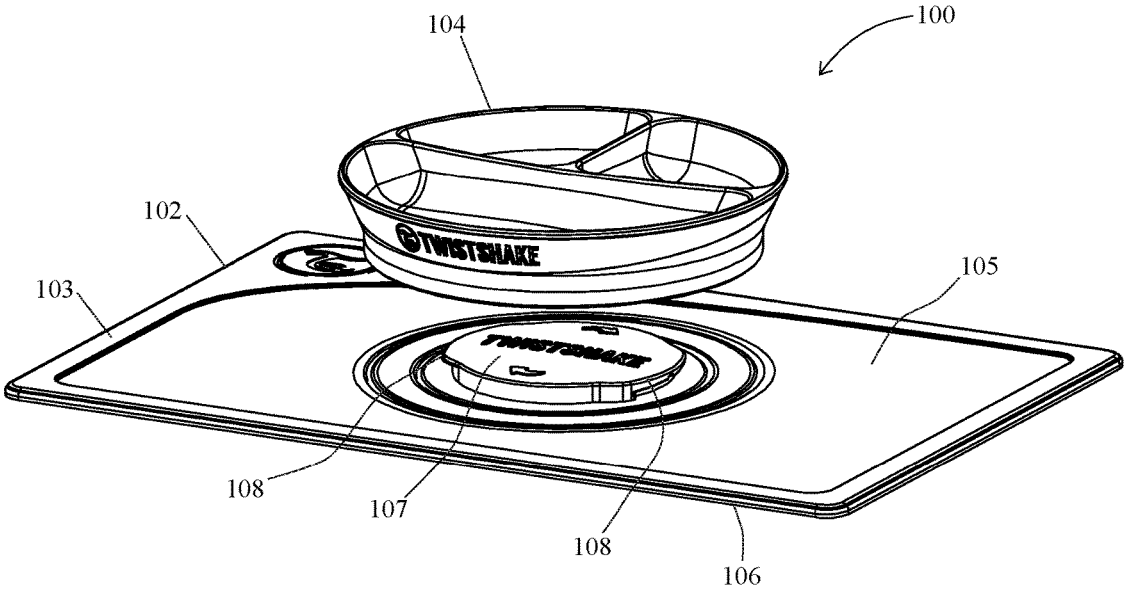
FIG. 1 illustrates a perspective view from above of a tableware system in a detached configuration according to one example of the technology.

What is needed is an improved tableware system that includes a dining placemat with non-integrated tableware, where the dining placemat may be secured to an underlying surface by partial vacuum. According to one example, the tableware may include a fastening mechanism that engages a corresponding fastening mechanism provided on the dining placemat. According to one example, the tableware may include a lid with a fastening mechanism that engages a corresponding fastening mechanism provided on another article of tableware. According to one example, a structure of the fastening mechanism provided on the dining mat may be similar to a structure of the fastening mechanism provided on the lid. In this way, two or more articles of tableware may be fastened to the dining mat concurrently. For example, two or more articles of tableware may be fastened to a single dining placemat that is secured to an underlying surface by partial vacuum. For example, two or more articles of tableware may be vertically stacked on a single dining placemat that is secured to an underlying surface by partial vacuum. In a stacked configuration, the tableware may be interchangeably fastened directly to the dining mat. According to one example, the technology may be used in various environments that benefit from a tableware system secured to an underlying surface such as households, restaurants, ships, yachts, boats, airplanes, cars, or the like.

It will be appreciated that for simplicity and clarity of illustration, where appropriate, reference numerals may be repeated among the different figures to indicate corresponding or analogous elements. In addition, numerous specific details are set forth in order to provide a thorough understanding of the examples described herein. However, it will be understood by those of ordinary skill in the art that the examples described herein may be practiced without these specific details. In other instances, methods, procedures, and components have not been described in detail so as not to obscure the related relevant feature being described. Also, the description is not to be considered as limiting the scope of the examples described herein. The drawings are not necessarily to scale and the dimensions of certain parts may have been exaggerated to better illustrate details and features of the present disclosure. Those skilled in the art with access to the teachings provided herein will recognize additional modifications, applications, and examples within the scope thereof and additional fields in which the technology may be of significant utility.

Unless defined otherwise, technical terms used herein have the same meaning as is commonly understood by one of ordinary skill in the art to which this disclosure belongs. The terms "first," "second," and the like, as used herein do not denote any order, quantity, or importance, but rather are used to distinguish one element from another. Also, the terms "a" and "an" do not denote a limitation of quantity, but rather denote the presence of at least one of the referenced items. The term "or" is meant to be inclusive and means either, any, several, or all of the listed items. The terms "comprising," "including," and "having" are used interchangeably in this disclosure. The terms "comprising," "including," and "having" mean to include, but are not necessarily limited to the things so described. The terms "connected" and "coupled" can be such that the objects are permanently connected or releasably connected. The term "substantially" is defined to be essentially conforming to the thing that it "substantially" modifies, such that the thing need not be exact. For example, substantially 2 inches (2") means that the dimension may include a slight variation.

FIG. 1 illustrates a tableware system 100 according to one example of the technology. According to one example, the tableware system 100 includes a placemat or mat 102 and tableware 104. According to one example, the mat 102 and tableware 104 may be detachably coupled. According to one example, the mat 102 may include substantially planar top and bottom surfaces 105, 106, respectively. According to one example, the top surface 105 may include a raised edge 103 provided along a perimeter of the mat 102. One of ordinary skill in the art will readily appreciate that the mat 102 may be formed of any shape. According to one example, the mat 102 may be formed in a substantially rectangular-shape.

According to one example, the mat 102 may include a fastening mechanism 107 that secures the tableware 104 thereto. According to one example, the fastening mechanism 107 may be integrally formed with the mat 102. For example, the fastening mechanism 107 may be embedded within the mat 102. Alternatively, the fastening mechanism 107 may be detachably coupled to the top surface 105 of the mat 102. For example, the fastening mechanism 107 may be secured to the top surface 105 of the mat 102 using a fastener such as a screw, adhesive, peg, or the like. According to one example, the fastening mechanism 107 may protrude from the top surface 105 of the mat 102. According to one example, the fastening mechanism 107 may be centrally located on the top surface 105 of the mat 102. Alternatively, the fastening mechanism 107 may be located anywhere along the top surface 105 of the mat 102. One of ordinary skill in the art will readily appreciate that the mat 102 may include two or more fastening mechanisms 107 provided at the top surface 105. For example, the two or more fastening mechanisms 107 may secure multiple articles of tableware 104 such as plates, bowls, cups, utensils, or the like.

Figure 2:
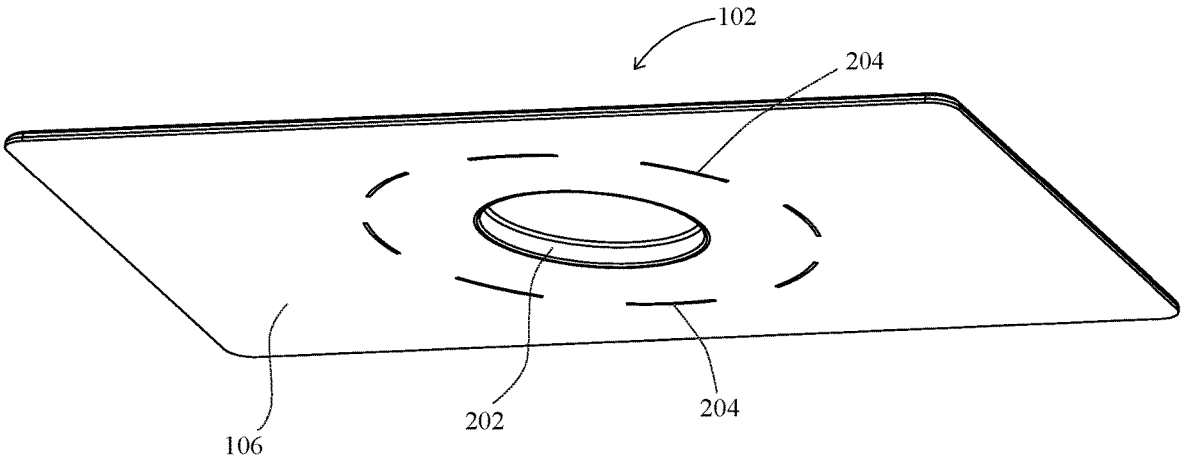
FIG. 2 illustrates a perspective view from below of a mat without a fastening mechanism included therein according to one example of the technology.

According to one example, the fastening mechanism 107 may include a disc-shaped protrusion that extends in a direction perpendicular to the top surface 105. According to one example, the disc-shaped protrusion may include flanges 108 that extend in a radial direction from a perimeter thereof. According to one example, the flanges 108 may increase in thickness along a direction perpendicular to the top surface 105 to form a wedge-shaped profile. FIG. 2 illustrates the mat 102 having a planar bottom surface 106 according to one example of the technology. According to one example, the mat 102 may include an aperture 202 that corresponds to an underside of the protruding portion of the fastening mechanism 107. According to one example, multiple mats 102 may be stacked such that the protruding portion of the fastening mechanism 107 of an underlying mat 102 is inserted into the aperture 202 of an overlying mat 102. Additionally, the mat 102 may include one or more slots 204 provided around a periphery of the aperture 202. According to one example, the slots 204 may be dimensioned to receive protrusions that extend downward from the fastening mechanism 107. According to one example, the slots 204 fixedly secure the fastening mechanism 107 in place. For example, the slots 204 may provide increased strength to a bond formed between the fastening mechanism 107 and the mat 102. One of ordinary skill in the art will readily appreciate that the fastening mechanism 107 may be integrally formed with the mat 102.

According to one example, the bottom surface 106 of the mat 102 may be formed from a material having a tacky finish that provides a high coefficient of friction ($\mu$), where $\mu$ is determined based on a weight of an object and how much force is needed to begin sliding the object across a surface. For example, a material for the bottom surface 106 may be selected to form a partial vacuum with a contacting surface such as a table, countertop, tray, or the like. In this case, the material may be selected such that a force needed to slide the tableware system 100 across the contacting surface exceeds a force needed to lift the tableware system 100 from the contacting surface. According to one example, an edge of the mat 102 may be peeled to remove the mat 102 from the underlying surface. According to one example, the selected material may include silicone, rubber, or the like. One of ordinary skill in the art will readily appreciate that the top and bottom surfaces of the mat may be formed from different material having different properties.

Figure 3:
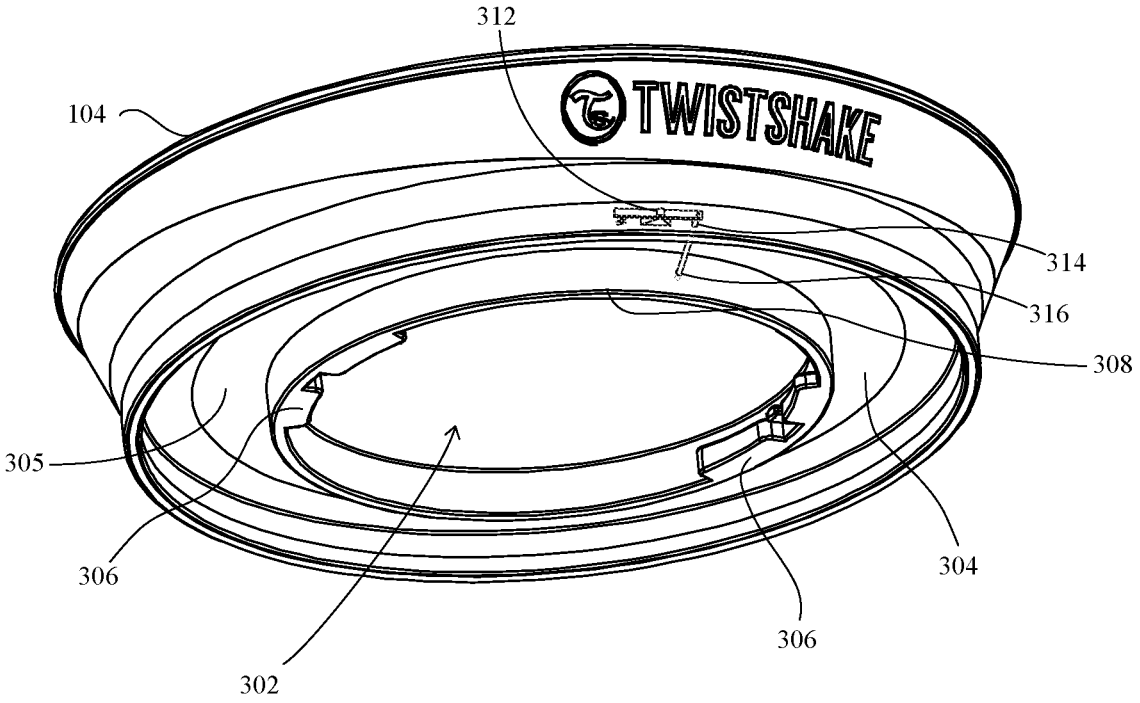
FIG. 3 illustrates a side view of the tableware system illustrated in FIG. 1.
Figure 3:
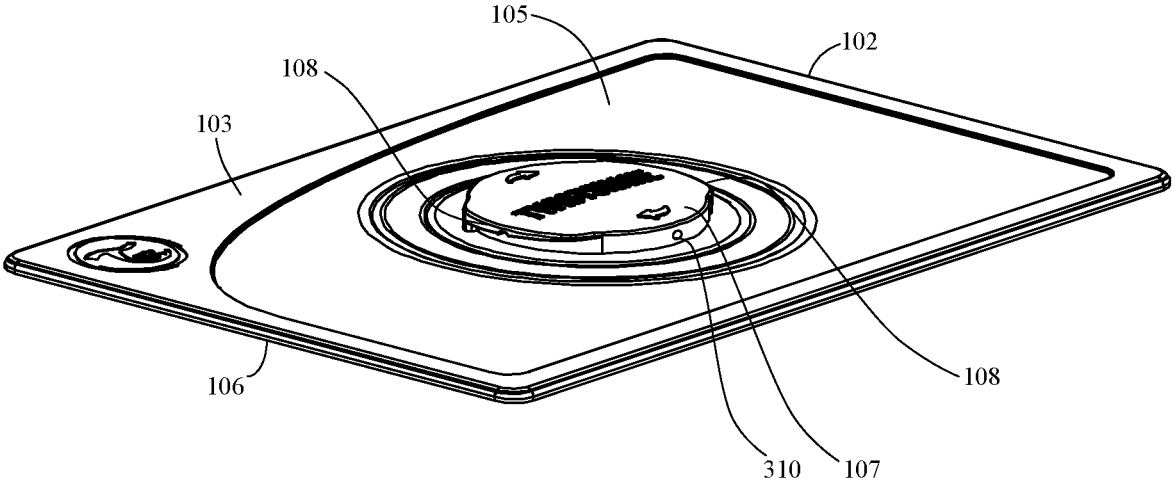

With reference to FIG. 3, the tableware 104 may include a corresponding fastening mechanism 302 provided at a bottom surface 304 thereof to mechanically couple to the fastening mechanism 107 of the mat 102. According to one example, the fastening mechanism 302 may include a cavity formed at the bottom surface 304 of the tableware 104. According to one example, a rim 308 may be provided that extends substantially perpendicular from the bottom surface 304 of the tableware 104 to define an outer boundary of the cavity that receives the fastening mechanism 107. According to one example, tabs 306 may be provided along an edge of the rim 308. For example, the tabs 306 may extend inward from the edge of the rim 308 to engage the flanges 108 provided on the fastening mechanism 107 of the mat 102. According to one example, the tableware 104 may be positioned over the mat 102 such that the fastening mechanism 302 is seated substantially over the corresponding fastening mechanism 107. According to one example, the tableware 104 may be rotated in a clockwise direction such that the tabs 306 engage the flanges 108.

Figure 4:
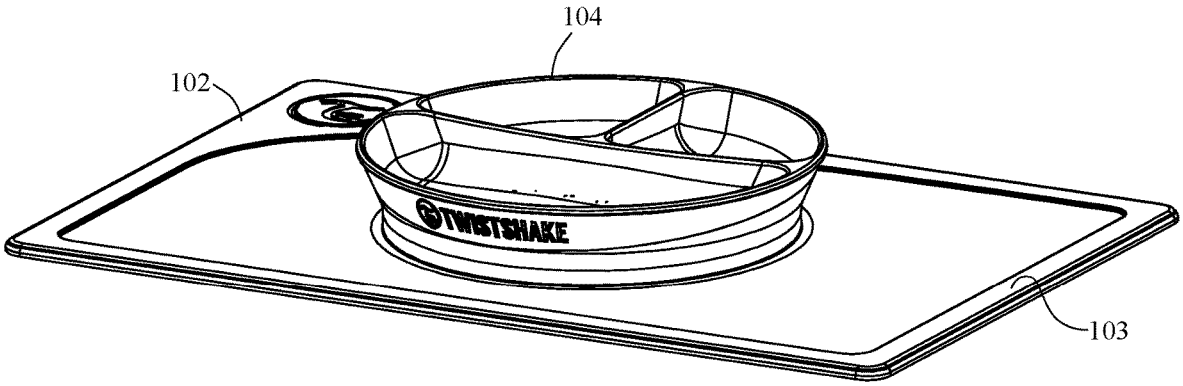
FIG. 4 illustrates a perspective view from above of the tableware system in an attached configuration according to one example of the technology.

With reference to FIG. 4, clockwise rotation of the tableware 104 will cause the tabs 306 to engage the wedge-shaped profile of the flanges 108 provided on the fastening mechanism 107 to drive the bottom surface 304 of the tableware 104 toward the top surface 105 of the mat 102. According to one example, the fastening mechanisms 107, 302 are configured to mechanically couple the tableware 104 and the mat 102. According to one example, the tableware 104 and the mat 102 may become fixedly engaged such that a release mechanism or tool is needed to disengage the fastening mechanisms 107, 302. One of ordinary skill in the art will readily appreciate that other fastening mechanisms may be provided to fixedly engage the tableware 104 and the mat 102.

The tableware system 100 described herein is an improvement over known tableware systems. For example, infants and children that observe removal of an integrated placemat with the non-separable tableware provided in known systems quickly learn how to peel the edge to release the placemat. Once released, the infants and children using known tableware systems may overturn or knock the tableware off a table. In contrast, the tableware system 100 described herein allows the placemat 102 to remain affixed in place while the fastening mechanisms 107, 302 are disengaged to release the tableware 104. In this way, infants and children do not learn how to remove the placemat 102 to overturn or knock the tableware off the table.

According to one example, the tableware system 100 may include a lock 312 that fixedly secures the fastening mechanisms 107, 302. According to one example, the lock 312 may include a release mechanism that is maintained with the tableware system 100. Alternatively, the lock may require a separate tool that is applied to disengage the lock. According to one example, the lock may include a pin that inserts through apertures 310, 314, 316 provided in the rim 308 and at a side wall of the fastening mechanism 107 that align when the fastening mechanisms 107, 302 are engaged. According to one example, the release mechanism may be coupled to the rim 308 of the tableware 104 and may include a spring-loaded pin such that a tip of the pin is inserted by spring force through the apertures 310, 314, 316 in the rim 308 and the side wall of the fastening mechanism 107 when the fastening mechanisms 107, 302 are engaged. According to one example, a counter-force may be applied to the release mechanism to extract the pin prior to disengaging the fastening mechanisms 107, 302. One of ordinary skill in the art will readily appreciate that other release mechanisms may be employed so that infants and children are incapable of separating the placemat 102 and the tableware 104 to prevent overturning or knocking the tableware off the table. According to one example, the release mechanism may require application of a force to disengage the tableware 104 from the placemat 102.

According to another example, the lock may include a stand-alone pin 700 with an expanding tip 702. According to one example, the rim 308 and the side wall of the fastening mechanism 107 may include apertures 310, 314, 316 that align when the fastening mechanisms 107, 302 are engaged. According to one example, the pin 700 may be inserted through the apertures 310, 314, 316 when the fastening mechanisms 107, 302 are engaged such that the expanding tip 702 of the pin 700 penetrates through the rim 308 and the side wall of the fastening mechanism 107. According to one example, the tool may be used to retract the expanding tip 702 in order to remove the pin 700 prior to disengaging the fastening mechanisms 107, 302. One of ordinary skill in the art will readily appreciate that other tool types may be employed so that infants and children are incapable of separating the placemat 102 and the tableware 104 to prevent overturning or knocking the tableware off the table.

According to one example, the mat 102 may include a valve that may be coupled to a vacuum pump for removing air from between the mat 102 and the underlying contact surface. In this way, a suction force may be increased between the mat 102 and the underlying surface to prevent removal of the mat 102 from the underlying surface by peeling an edge of the mat 102. According to one example, the mat 102 may include a relief valve 402 that releases pressure holding the mat 102 onto the underlying surface such that the mat 102 may be peeled from the underlying surface. Accordingly, it may not be possible to remove the mat 102 from the underlying surface without first relieving pressure using the relief valve 402.

Figure 5:
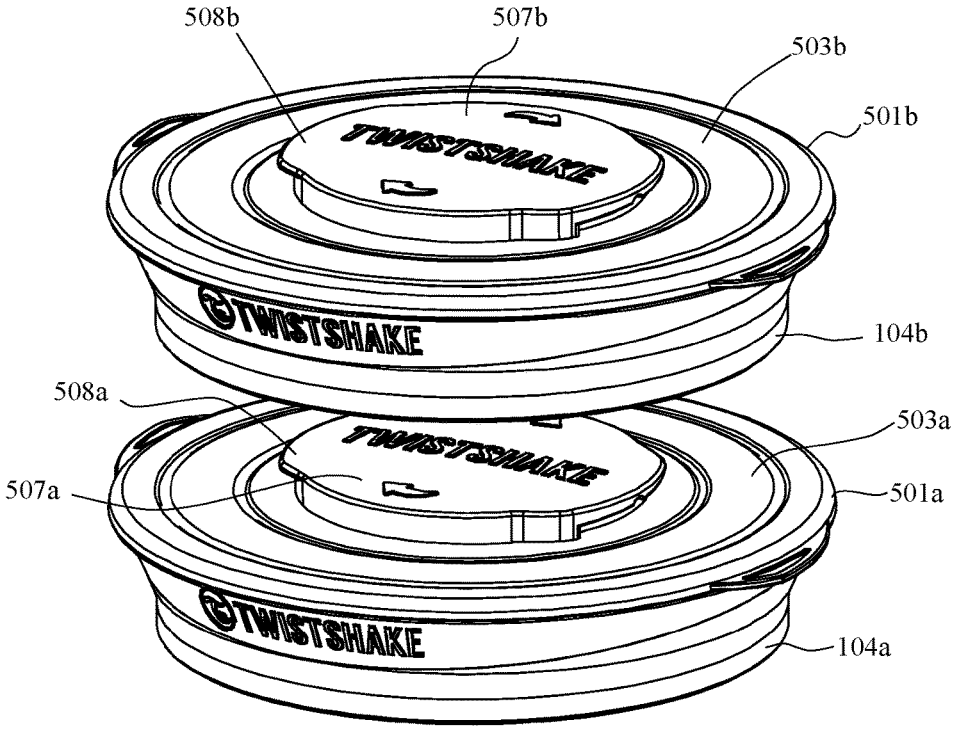
FIG. 5 illustrates a top view of stacked tableware in a detached configuration according to one example of the technology.
Figure 6:
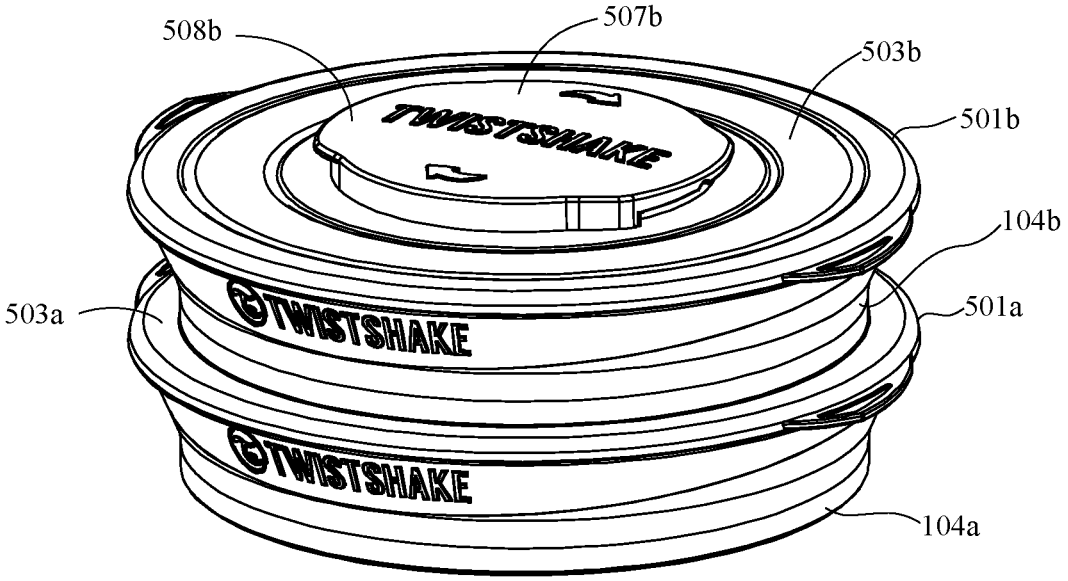
FIG. 6 illustrates a top view of stacked tableware in an attached configuration according to one example of the technology.
Figure 7:
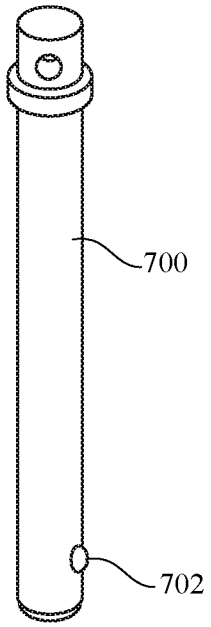
FIG. 7 illustrates a stand-alone pin according to one example of the technology.

FIGS. 5 and 6 illustrate vertically stacked tableware 104*a*,104*b* according to one example of the technology. According to one example, lids 501*a*,501*b* may be provided that secure to the tableware 104*a*,104*b*. According to one example, the lids 501*a*,501*b* may be secured to the tableware 104*a*,104*b* using a threaded coupling, pressure coupling, or the like. According to one example, the lids 501*a*,501*b* may include a fastening mechanism 507*a*, 507*b* for vertically stacking the tableware 104*a*,104*b*. According to one example, the fastening mechanism 507*a*, 507*b* may be integrally formed with the lids 501*a*,501*b*. Alternatively, the fastening mechanism 507*a*, 507*b* may be detachably coupled to a top surface 503*a*,503*b* of the lids 501*a*,501*b*. For example, the fastening mechanism 507*a*, 507*b* may be secured to the top surface 503*a*,503*b* of the lids 501*a*,501*b* using a fastener such as a screw, adhesive, peg, or the like. According to one example, the fastening mechanism 507*a*, 507*b* may protrude from the top surface 503*a*,503*b* of the lids 501*a*,501*b*.

According to one example, the fastening mechanism 507*a*, 507*b* may include a disc-shaped protrusion that extends in a direction perpendicular to the top surface 503*a*,503*b* of the lids 501*a*,501*b*. According to one example, the disc-shaped protrusion may include flanges 508*a*,508*b* that extend in a radial direction from a perimeter thereof. According to one example, the flanges 508*a*,508*b* may increase in thickness along a direction perpendicular to the top surface 503*a*,503*b* to form a wedge-shaped profile. According to one example, the tableware 104*a*,104*b* may include a corresponding fastening mechanism provided at a bottom surface thereof to mechanically couple to the fastening mechanism 507*a*, 507*b* provided on the lids 501*a*, 501*b*. According to one example, the fastening mechanism may include a cavity formed at the bottom surface of the tableware 104*a*,104*b*. According to one example, a rim may be provided that extends substantially perpendicular from the bottom surface of the tableware 104*a*,104*b* to define an outer boundary of the cavity that receives the fastening mechanism 507*a*, 507*b*. According to one example, tabs may be provided along an edge of the rim. For example, the tabs may extend inward from the edge of the rim to engage the flanges 508*a*,508*b* provided on the fastening mechanisms 507*a*, 507*b* of the lids 501*a*,501*b*.

According to one example, the tableware 104*a*,104*b* may be positioned over the lids 501*a*,501*b* such that the fastening mechanism is seated substantially over the corresponding fastening mechanism 507*a*, 507*b*. According to one example, the tableware 104*a*,104*b* may be rotated in a clockwise direction such that the tabs engage the flanges 508*a*,508*b*. With reference to FIG. 6, clockwise rotation of the tableware 104*a*,104*b* will cause the tabs to engage the wedge-shaped profile of the flanges 508*a*,508*b* provided on the fastening mechanisms 507*a*, 507*b* to drive the bottom surface of the tableware 104*a*,104*b* toward the top surface 503*a*,503*b* of the lids 501*a*,501*b*. According to one example, the fastening mechanisms provided on the tableware 104*a*, 104*b* and lids 501*a*,501*b* are configured to mechanically couple the tableware 104*a*,104*b* and the lids 501*a*,501*b*. According to one example, the tableware 104*a*,104*b* and the lids 501*a*,501*b* may become fixedly engaged such that a release mechanism or tool is needed to disengage the fastening mechanisms. One of ordinary skill in the art will readily appreciate that other fastening mechanisms may be employed to fixedly engage the tableware 104*a*,104*b* and the lids 501*a*,501*b*.

According to one example, the tableware 104*a*,104*b* may be formed of a rigid material such as plastic. For example, the tableware 104*a*,104*b* may be formed from Bisphenol A (BPA) and 2-ethylhexyl (DEHP) free plastic or a similar material. According to one example, the tableware 104*a*, 104*b* may be formed from a microwave safe material. According to one example, the tableware 104*a*,104*b* may be formed from an insulating material that maintains the contents in a heated or cooled state. According to one example, an interior of the tableware 104 may be partitioned into two or more compartments as illustrated in FIGS. 1 and 4. Alternatively, the interior of the tableware 104 may include a single compartment. According to one example, the lid 501*a*,501*b* may form a fluid tight seal with an upper surface of the tableware 104*a*,104*b* such that any foods or liquids provided within the compartments does not migrate to other compartments when the lid 501*a*,501*b* is applied.

It will be readily understood by those persons skilled in the art that this technology is susceptible to broad utility and application. Many examples and adaptations of the technology other than those herein described, as well as many variations, modifications and equivalent arrangements, will be apparent from or reasonably suggested by this technology and foregoing description thereof, without departing from the substance or scope of the technology.

While the foregoing illustrates and describes examples of this technology, it is to be understood that the technology is not limited to the construction disclosed herein. The technology can be embodied in other specific forms without departing from its spirit or essential attributes.

What is claimed is:

1. A tableware system, comprising:

a placemat having a substantially planar bottom surface that forms a partial vacuum when provided in contact with an underlying surface, the placemat having an aperture and slots provided around a perimeter of the aperture;

a first fastening mechanism provided at a top surface of the placemat to coincide with the aperture, the first fastening mechanism having first protrusions that extend downward partially through the slots, the first fastening mechanism defining a second protrusion that extends in a direction substantially perpendicular to the top surface, the first fastening mechanism defining an aperture at an underside of the second protrusion;

tableware having a second fastening mechanism that corresponds to the first fastening mechanism, the second fastening mechanism being detachably coupled to the first fastening mechanism, the tableware being dimensioned so that the placemat perimeter extends beyond a perimeter of the tableware; and a lid that secures to the tableware, the lid including another first fastening mechanism provided at a top surface thereof.

2. The tableware system according to claim 1, wherein the second protrusion includes flanges that extend in an outward direction from a periphery thereof, the flanges having an increased thickness along a direction perpendicular to the top surface to form a wedge-shaped profile.

3. The tableware system according to claim 2, wherein the second fastening mechanism is provided at a bottom surface of the tableware, the second fastening mechanism having a cavity defined by a rim, the rim including tabs that extend inward to engage the flanges provided on the first fastening mechanism.

4. The tableware system according to claim 3, wherein the second fastening mechanism is rotated over the first fastening mechanism to detachably couple the placemat and the tableware.

5. The tableware system according to claim 4, further comprising a lock that fixedly secures the first fastening mechanism and the second fastening mechanism, the lock includes a pin that is inserted through apertures provided in the first fastening mechanism and the second fastening system when coupled, the lock having a release mechanism that extracts the pin upon application of a force thereto to allow the tableware and the placemat to be detached.

6. The tableware system according to claim 4, further comprising a lock that fixedly secures the first fastening mechanism and the second fastening mechanism, the lock includes a stand-alone pin that is inserted through apertures provided in the first fastening mechanism and the second fastening system when coupled, the stand-alone pin being removable by a separate tool to allow the tableware and the placemat to be detached.

7. The tableware system according to claim 1, wherein the substantially planar bottom surface is formed from a material having a tacky finish that provides a coefficient of friction determined based on weight.

8. The tableware system according to claim 1, wherein the tableware with the lid secured thereto is stackable with other tableware having another lid secured thereto.

9. The tableware system according to claim 1, wherein the substantially planar bottom surface is formed from a different material than the top surface.

10. A tableware system, comprising:

a placemat having a substantially planar bottom surface that forms a partial vacuum when provided in contact with an underlying surface, the placemat having an aperture and slots provided around a perimeter of the aperture;

a first fastening mechanism provided at a top surface of the placemat to coincide with the aperture, the first fastening mechanism having first protrusions that extend downward partially through the slots, the first fastening mechanism including a second protrusion that extends in a direction substantially perpendicular to the top surface, the first fastening mechanism defining an aperture at an underside of the second protrusion, the second protrusion having flanges that extend in an outward direction from a periphery thereof, the flanges having an increased thickness along the direction perpendicular to the top surface to form a wedge-shaped profile; and tableware having a second fastening mechanism that corresponds to the first fastening mechanism, the second fastening mechanism being detachably coupled to the first fastening mechanism, the tableware being dimensioned so that the placemat perimeter extends beyond a perimeter of the tableware.

11. The tableware system according to claim 10, wherein the second fastening mechanism is provided at a bottom surface of the tableware, the second fastening mechanism having a cavity defined by a rim, the rim including tabs that extend inward to engage the flanges provided on the first fastening mechanism.

12. The tableware system according to claim 11, wherein the second fastening mechanism is rotated over the first fastening mechanism to detachably couple the placemat and the tableware.

13. The tableware system according to claim 10, wherein the substantially planar bottom surface is formed from a material having a tacky finish that provides a coefficient of friction determined based on weight.

14. The tableware system according to claim 10, further comprising a lid that secures to the tableware, the lid including another first fastening mechanism provided at a top surface thereof.

15. A tableware system, comprising:

a placemat having a substantially planar bottom surface that forms a partial vacuum when provided in contact with an underlying surface, the placemat having an aperture and slots provided around a perimeter of the aperture;

a first fastening mechanism provided at a top surface of the placemat to coincide with the aperture, the first fastening mechanism having first protrusions that extend downward partially through the slots, the first fastening mechanism including a second protrusion that extends in a direction substantially perpendicular to the top surface, the first fastening mechanism defining an aperture at an underside of the second protrusion, the second protrusion having flanges that extend in an outward direction from a periphery thereof, the flanges having an increased thickness along a direction perpendicular to the top surface to form a wedge-shaped profile; and tableware having a second fastening mechanism that corresponds to the first fastening mechanism, the second fastening mechanism being detachably coupled to the first fastening mechanism, the second fastening mechanism being provided at a bottom surface of the tableware, the second fastening mechanism having a cavity defined by a rim, the rim including tabs that extend inward to engage the flanges provided on the first fastening mechanism, the tableware being dimensioned so that the placemat perimeter extends beyond a perimeter of the tableware.

16. The tableware system according to claim 15, wherein the second fastening mechanism is rotated over the first fastening mechanism to detachably couple the placemat and the tableware.

17. The tableware system according to claim 16, further comprising a lock that fixedly secures the first fastening mechanism and the second fastening mechanism, the lock includes a stand-alone pin that is inserted through apertures provided in the first fastening mechanism and the second fastening system when coupled, the stand-alone pin being removable by a separate tool to allow the tableware and the placemat to be detached.

18. The tableware system according to claim 16, further comprising a lock that fixedly secures the first fastening mechanism and the second fastening mechanism, the lock includes a pin that is inserted through apertures provided in the first fastening mechanism and the second fastening system when coupled, the lock having a release mechanism that extracts the pin upon application of a force thereto to allow the tableware and the placemat to be detached.

19. The tableware system according to claim 15, wherein the substantially planar bottom surface is formed from a material having a tacky finish that provides a coefficient of friction determined based on weight.

20. The tableware system according to claim 15, further comprising a lid that secures to the tableware, the lid including another first fastening mechanism provided at a top surface thereof.

* * * * *